US006584948B2

(12) United States Patent
Auer et al.

(10) Patent No.: US 6,584,948 B2
(45) Date of Patent: Jul. 1, 2003

(54) INTERNAL COMBUSTION ENGINE

(75) Inventors: Christian Auer, Stadt Haag (AT); Robert Roithinger, St. Valentin (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 10/014,492

(22) Filed: Dec. 14, 2001

(65) Prior Publication Data

US 2002/0073950 A1 Jun. 20, 2002

(30) Foreign Application Priority Data

Dec. 18, 2000 (AT) ..... 927/2000 U

(51) Int. Cl.[7] ..... F02F 1/24
(52) U.S. Cl. ..... 123/193.5
(58) Field of Search ..... 123/193.5, 193.3

(56) References Cited

U.S. PATENT DOCUMENTS 4,519,359 A * 5/1985 Dworak et al. ..... 123/193.5
4,524,732 A * 6/1985 Dworak et al. ..... 123/193.5
4,530,341 A * 7/1985 Palm ..... 123/669
4,774,912 A 10/1988 Nakano et al.

FOREIGN PATENT DOCUMENTS

| | | |
|---|---|---|
| CH | 389990 | 7/1965 |
| DE | 3039718 | 4/1981 |
| DE | 3307115 | 9/1984 |
| DE | 3523131 | 10/1986 |
| GB | 111095 | 8/1917 |

* cited by examiner

*Primary Examiner*—Marguerite McMahon
(74) *Attorney, Agent, or Firm*—Dykema Gossett PLLC

(57) ABSTRACT

An internal combustion engine includes a level plate that is arranged between a cylinder head and a cylinder, is adjacent to a combustion chamber and is provided with at least one opening for at least one inlet valve and/or one outlet valve and/or at least one injection equipment or the like, the plate bordering on a level cylinder head bottom. In order to reduce the introduction of heat into the cylinder head in the easiest possible way, the diameter of the opening is larger than the valve seat for the inlet valve and/or for the outlet valve and the valve seat for the inlet valve and/or for the outlet valve is formed by the cylinder head or by a valve seat ring that is solidly connected thereto.

15 Claims, 4 Drawing Sheets

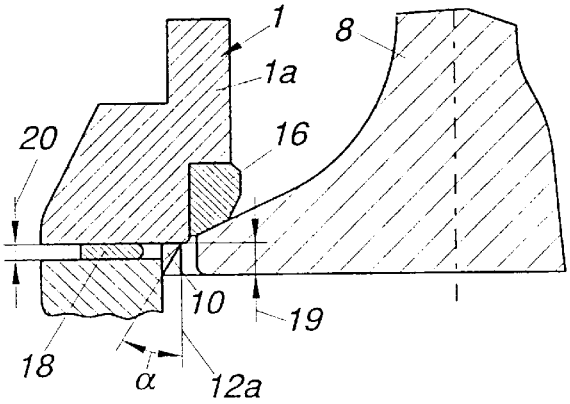
Fig. 5
Fig. 6
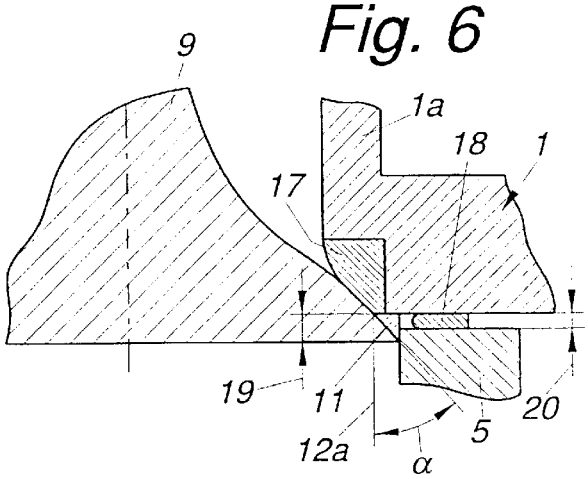
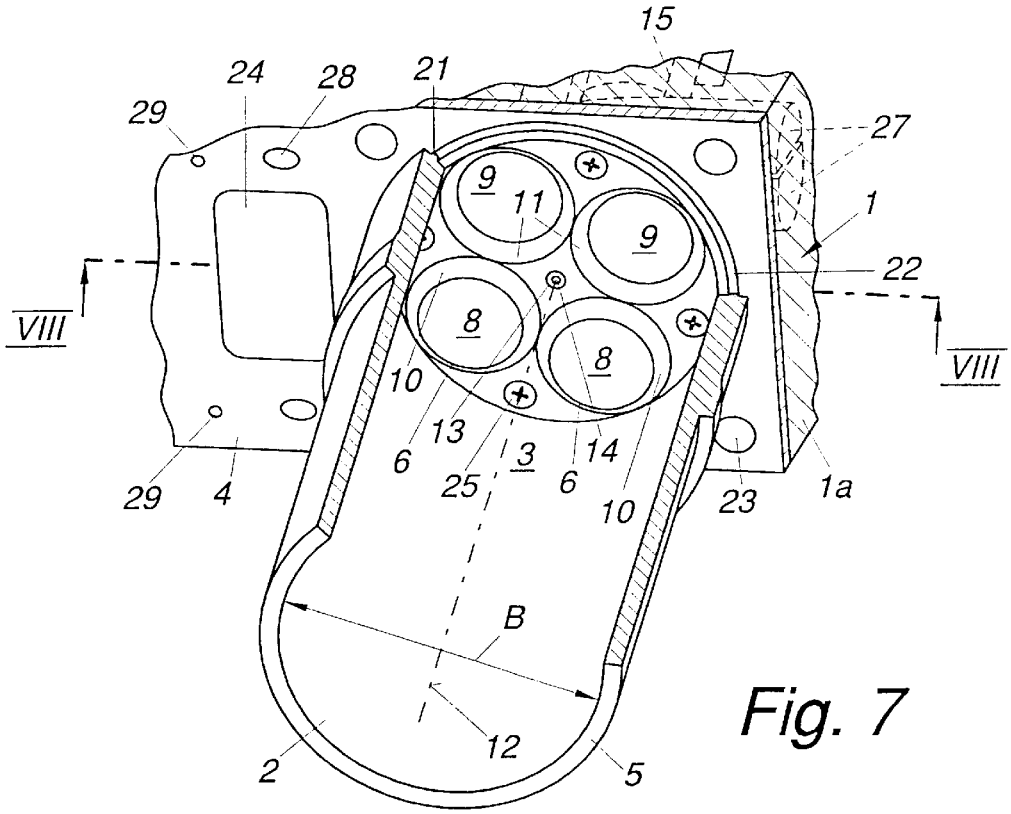
Fig. 7

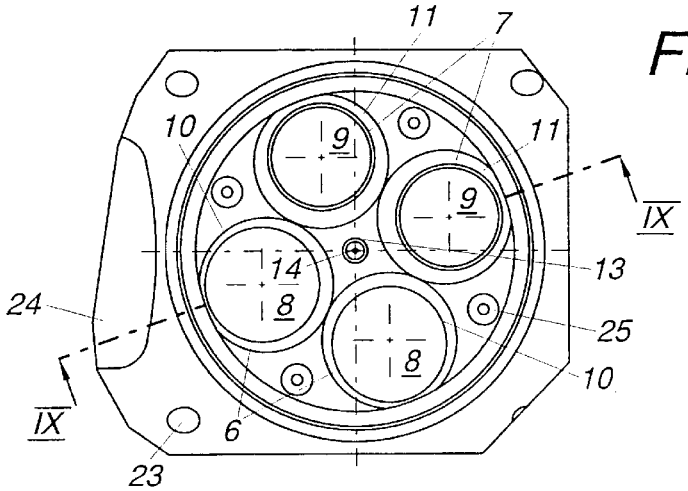
Fig. 8
Fig. 9
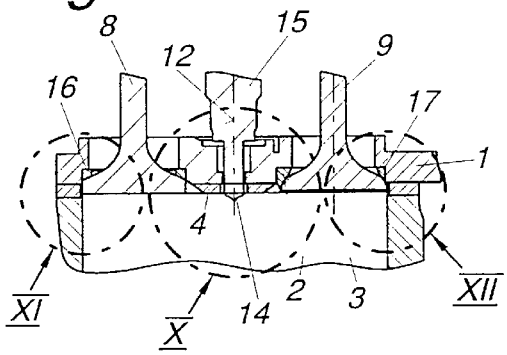
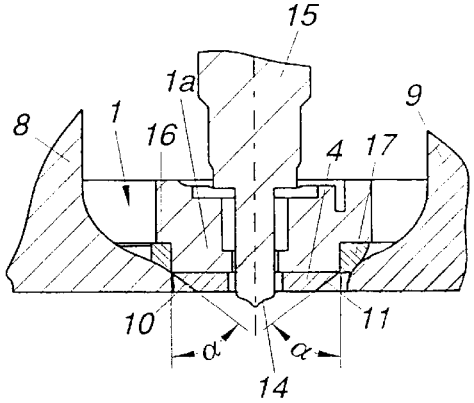
Fig. 10
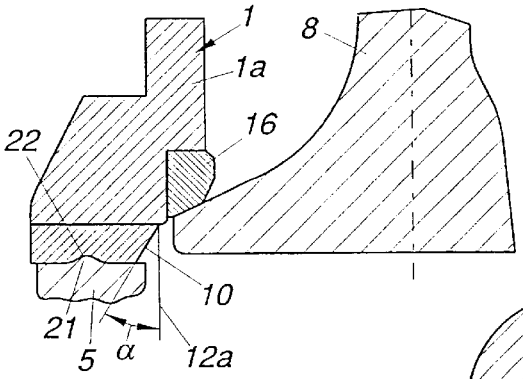
Fig. 11
Fig. 12
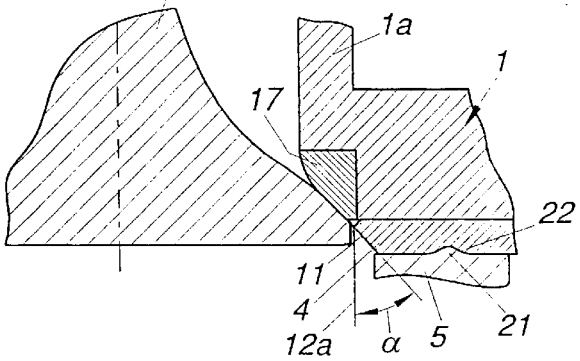

INTERNAL COMBUSTION ENGINE

BACKGROUND OF THE INVENTION

The invention relates to an internal combustion engine with a level plate that is arranged between a cylinder head and a cylinder, is adjacent to a combustion chamber, and is provided with at least one opening for at least one inlet valve and/or one outlet valve and/or at least one injection equipment or the like, the plate bordering on a level cylinder head bottom.

DESCRIPTION OF PRIOR ART

U.S. Pat. No. 4,774,912 A discloses a cylinder head for an internal combustion engine consisting of an upper part of a rigid structure that is provided with the cooling water passages and is closed by a bottom plate bordering on the water passages. The two parts of the cylinder head are joined to form a single common structure. As compared to the upper part, which is of a rigid structure, the bottom plate is made from a metal of higher high-temperature strength and lower thermal conductivity. Higher cylinder pressures may thus be realized. However, the water passages, which directly abut on the bottom plate, require the upper part to be constructed separately and sealing measures for the coolant to be carried out, which increases the cost of production.

The German Patent No. 33 07 115 A1 describes a cylinder head for an internal combustion engine, whose face opposing the combustion chamber is covered by a plate that is provided with openings for valves, spark plugs or injection nozzles. This plate is intended to insulate the cylinder head on the side of the combustion chamber. The circular plate is thereby shrunk in a collar configured in the cylinder head. This presents the disadvantage that the cylinder head bottom must be processed separately and that the shrinking procedure requires additional stages, which again substantially increases the cost of production. Furthermore, the cylinder head bottom is weakened by stress concentration. Similar plates have been described in the publications CH 389 990 A, DE 35 23 131 C1 and DE 30 39 718 A1.

The British Patent GB 111 095 A1 discloses an internal combustion engine with a bottom plate that borders on a level cylinder head bottom. The valve seat is provided in the bottom plate.

SUMMARY OF THE INVENTION

It is the object of the present invention to achieve in the easiest possible way that, in an internal combustion engine of the type mentioned herein above, less heat be introduced into the cylinder head.

This is achieved in accordance with the invention in that the diameter of the opening is larger than the valve seat for the inlet valve and/or for the outlet valve and that the valve seat for the inlet valve and/or for the outlet valve is formed by the cylinder head or by a valve seat ring that is solidly connected thereto. Accordingly, the function of the valve seat is performed by the cylinder head in a conventional manner. As a result thereof, the plate can be very simple in construction. The level plate is thereby flush with a level connecting face of the cylinder head bottom. The cylinder head bottom needs not be provided with collar-like cavities in order to insert the plate. Accordingly, the cylinder head bottom is of a closed and level realization except for the openings for the inlet valves, the outlet valves, the injection equipments, the blowby of water and/or the cylinder head studs. As a result thereof, a standard cylinder head may be used without any constructional change or additional stages in processing. Existing standard cylinder heads can be readily retrofit using the bottom plate. Furthermore and in spite of the protruding valves, a piston without pocket, i.e., with a crown that is level too, may be utilized. For reasons of stability this is to be preferred when ignition pressures and thermal stress are high.

In a variant in accordance with the present invention there is provided that the diameter of the plate corresponds at the utmost to the bore diameter of the cylinder. In this event, the plate has a circular outline and is preferably fastened to the cylinder head by means of fastening screws. Alternatively or in addition thereto, a swivel nut may fasten the plate in a location bore for the injector.

In a particularly preferred variant of the invention there is provided that the plate extends completely beyond the cylinder and is pressed against the cylinder block and/or a cylinder liner arranged in said cylinder block by the cylinder head. A separate cylinder head gasket may be dispensed with when the plate constitutes a sealant between cylinder head and cylinder block and forms the sealing faces toward the cylinder housing and/or the cylinder liner.

The plate may thereby extend along the entire length and/or width of the cylinder head. The cylinder head may be designed as a single cylinder head or as a multi-cylinder head. It is of particular advantage when the plate is provided with at least one port for the blowby of water between cylinder housing and cylinder head. As a result thereof, no separate sealants are needed in the region of the blowby of water between cylinder housing and cylinder head either. Advantageously, the plate is also provided with passage holes enabling passage of cylinder head studs that press the plate via the cylinder head against the cylinder housing or the cylinder liner.

In a particularly preferred variant of the invention, the plate is provided with a bezel on the side of the combustion chamber, around at least one opening for an inlet or an outlet valve. The bezels can have an individual geometry that is favourable to the flow. This is particularly made possible when the bezel has at least two regions with differential angles of the bezel that are defined between said bezel and a parallel to the axis of the cylinder, the change in the angle of the bezel between the regions being preferably designed to be continuous, the valve seat rings being, as already described, arranged in the cylinder head bottom in the same way as conventional cylinder heads. Since the bezels of the cylinder head bottom for the inlet or outlet valves are not arranged in the cylinder head bottom but in the plate, the effective height of the valve seat ring may be reduced, which has a favourable effect on guiding the coolant in the water cooling jacket of the cylinder head.

To effectively reduce the introduction of heat into the cylinder head bottom, it is particularly advantageous to have the plate made from a highly creep-resistant alloy or from ceramics. However, it is also possible to make the plate from an austenitic or martensitic stainless steel or from cast steel.

DESCRIPTION OF THE DRAWINGS

The invention is explained in closer detail herein after with reference to the drawings.

FIG. 5 is detail V of FIG. 3, FIG. 6 is detail VI of FIG. 3, FIG. 7 is an oblique sectioned view through a cylinder of a second variant of an internal combustion engine in accordance with the invention, FIG. 8 is a view of the cylinder head taken from the side of the combustion chamber along the line VIII—VIII in FIG. 7, FIG. 9 is a section through the internal combustion engine taken along the line IX—IX in FIG. 8, FIG. 10 is detail X of FIG. 9, FIG. 11 is detail XI of FIG. 9, FIG. 12 is detail XII of the internal combustion engine of FIG. 9

DETAILED DESCRIPTION OF THE PREFERRED EMBODIMENTS

Figure 1:
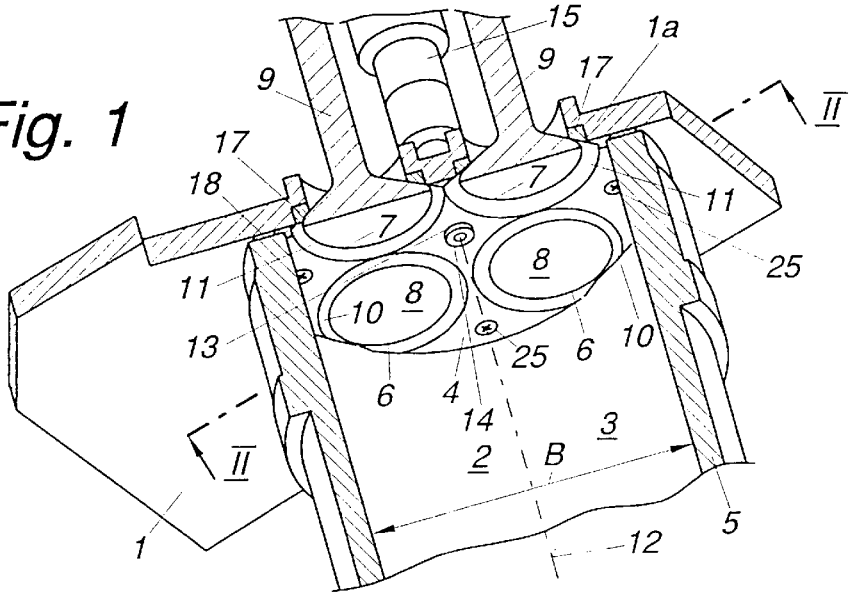
FIG. 1 is an oblique sectioned view through a cylinder of a first variant of an internal combustion engine in accordance with the invention.
Figure 2:
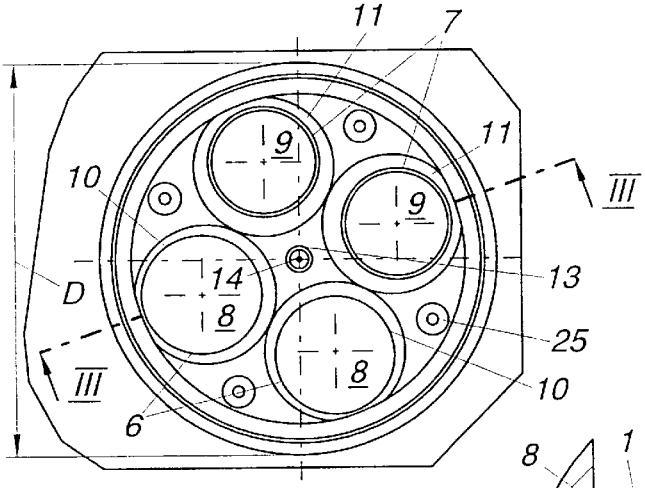
FIG. 2 is a view of the cylinder head taken from the side of the combustion chamber along the line II—II in FIG. 1.
Figure 4:
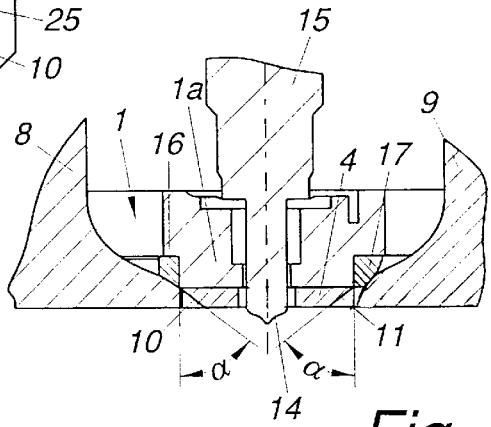
FIG. 4 is detail IV of FIG. 3.
Figure 3:
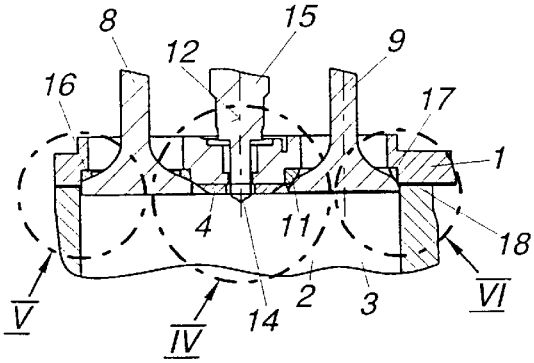
FIG. 3 is a section through the internal combustion engine taken along the line III—III in FIG. 2.

Elements with like functions will bear the same reference numerals throughout the variants of the invention.

A plate 4 that borders on the combustion chamber 3 is arranged between a cylinder head 1 and a cylinder 2. The level plate 4 snugly abuts on a cylinder head bottom la that is closed and level except for the openings provided for inlet valves 8 and/or outlet valves 9 and/or injection equipments 15. In the exemplary embodiments, the cylinder 2 is formed by a cylinder liner 5 that is arranged in a cylinder housing that has not been illustrated in the drawing herein. The level plate 4, which is made from a metallic material, is provided with openings 6, 7 for inlet valves 8 or outlet valves 9, respectively. In order to design a flow geometry that is favorable to gas exchange, bezels 10, 11 are formed in the respective one of the openings 6, 7 in the plate 4, each of said bezels having, in the direction of the periphery, an angle a that continuously changes relative to a parallel to the axis of the cylinder 12*a*. Furthermore, in the region of the cylinder axis 12, the plate 4 is provided with an opening 13 for the outlet 14 of an injection equipment 15 into the combustion chamber 3. In all of the variants, the valve seats of the inlet valves 8 or the outlet valves 9 that are formed by the valve seat rings 16, 17 are arranged in annular notches in flow passageways the cylinder head 1.

In the exemplary embodiment illustrated in the FIGS. 1 through 6 the plate 4 is circular and has a diameter D that maximally corresponds to the diameter B of the bore of cylinder 2. The plate 4 is fastened to the level cylinder head bottom 1*a* by way of screws 25. A cylinder head gasket 18 that performs the function of providing a seal between cylinder head 1 and cylinder liner 5 relative to combustion chamber 3 is arranged between cylinder head 1 and cylinder liner 5. As can be surveyed from the FIGS. 5 and 6, the thickness 19 of plate 4 in the direction of the cylinder axis 12 is greater or smaller than the dimension 20 through the cylinder head gasket 18.

The FIGS. 7 through 12 show a second variant in which the plate 4, which is arranged between cylinder head bottom 1*a* of cylinder head 1 and the cylinder liner(s) 5, extend beyond the diameter B of the bore of cylinder 2 and advantageously extends over the entire cylinder head bottom 1*a*. In this variant, a separate cylinder head gasket can be dispensed with when the plate 4 performs the function of sealing relative to the cylinder liner 5. To ensure tightness between cylinder liner 5 and plate 4 relative to combustion chamber 3, it is advantageous, for improved sealing, to configure a surrounding web 21 and/or a groove 22 in the region of the sealing face of cylinder liner 5 or of plate 4. The plate 4 can be coated or equipped with elastic sealing elements for sealing coolant and lubricants.

In the second variant, the plate 4 is provided, in addition to the openings 6 and 7 for the inlet valves 8 and the outlet valves 9 as well as to the opening 13 for the outlet 14 of the injection equipment 15, with bores 23 for the cylinder head studs as well as with at least one opening for the tappet rod 24, one for the blowby of water 28 and/or one for the blowby of oil 29 between cylinder housing and cylinder head 1. In FIG. 7, gas exchange conduits are indicated at reference numeral 27.

Figure 13:
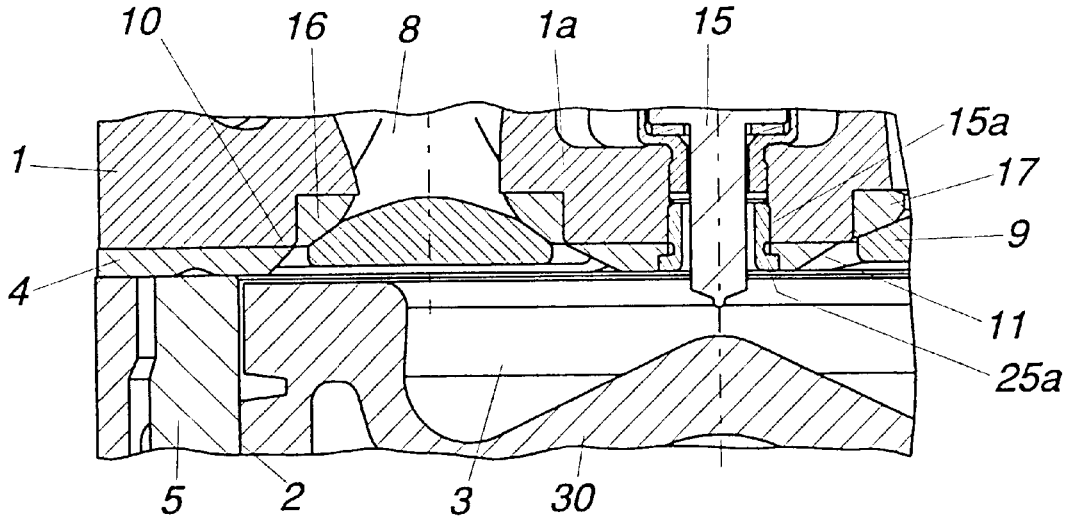
FIG. 13 is a section through another variant of an internal combustion engine according to the invention, analogous to FIG. 3.

FIG. 13 shows another variant in which the plate 4 is fastened around the injection equipment 15 in the location bore 15*a* by way of a clamping screw 25*a* used in addition to or instead of the screws 25. Reference numeral 30 designates a piston that reciprocates in the cylinder 2.

The plate 4, which is advantageously made from a creep-resistant alloy, reduces the introduction of heat into the cylinder head bottom 1*a* and thus lowers thermal stresses. This results in greater freedom in the choice of materials for the cylinder head 1. Furthermore, the bezels of the head bottom do not weaken the structure of the cylinder head.

What is claimed is:

1. An internal combustion engine with a level plate that is arranged between a cylinder head and a cylinder, is adjacent to a combustion chamber and is provided with at least one opening for at least one inlet valve and/or one outlet valve, said plate bordering on a level cylinder head bottom, wherein a diameter of the opening is larger than a valve seat for the inlet valve and/or for the outlet valve and that the valve seat for the inlet valve and/or for the outlet valve is formed by the cylinder head or by a valve seat ring that is fixedly positioned in an annular notch of a flow passageway in the cylinder head.

2. The internal combustion engine according to claim 1, wherein the plate is provided with a bezel on the side of the combustion chamber, around at least one opening for an inlet or an outlet valve.

3. The internal combustion engine according to claim 2, wherein the bezel has at least two regions with differential angles of the bezel that are defined between said bezel and a parallel to the axis of the cylinder, the change in the angle of the bezel between the regions being preferably designed to be continuous.

4. The internal combustion engine according to claim 1, wherein the plate on the cylinder head is fastened to the cylinder head bottom by means of screws.

5. The internal combustion engine according to claim 1, wherein the plate on the cylinder head is fastened in a location bore for the injector by means of a swivel nut.

6. The internal combustion engine according to claim 1, wherein the plate is provided with a substantially circular outline and wherein a diameter of the plate maximally corresponds to the diameter of the bore of the cylinder.

7. The internal combustion engine according to claim 1, wherein the plate extends completely beyond the cylinder and is pressed against the cylinder block and/or a cylinder liner arranged in said cylinder block by the cylinder head.

8. The internal combustion engine according to claim 7, wherein the plate constitutes a sealant between cylinder head and cylinder and forms the sealing faces toward the cylinder block and/or the cylinder liner.

9. The internal combustion engine according to claim 7, wherein the plate is provided, between cylinder housing and cylinder head, with at least one opening for a tappet rod, one for the blowby of water and/or one for the blowby of oil.

10. The internal combustion engine according to claim 7, wherein the plate is provided with at least one passage hole for a cylinder head stud.

11. The internal combustion engine according to claim 1, wherein the plate is made from a creep-resistant alloy.

12. The internal combustion engine according to claim 1, wherein the plate is made from an austenitic stainless steel.

13. The internal combustion engine according to claim 1, wherein the plate is made from a martensitic stainless steel.

14. The internal combustion engine according to claim 1, wherein the plate is made from cast steel.

15. The internal combustion engine according to claim 1, wherein the plate is made from ceramics.

* * * * *